United States Patent [19]

Ceballos-Aquilera

[11] 3,974,968

[45] Aug. 17, 1976

[54] PROCESS FOR THE MANUFACTURE OF SORGHUM FLOUR

[76] Inventor: Ing. Guillermo Ceballos-Aquilera, Escobedo Sur 733 Suite 201, Monterrey, Nuevo Leon, Mexico

[22] Filed: Dec. 26, 1974

[21] Appl. No.: 536,555

[52] U.S. Cl. ..... 241/11

[51] Int. Cl.[2] ..... B02C 9/04

[58] Field of Search ..... 241/7, 9, 11, 13

[56] References Cited

UNITED STATES PATENTS

| | | | |
|---|---|---|---|
| 267,016 | 11/1882 | Prinz | 241/11 |
| 344,246 | 6/1886 | Case | 241/11 X |
| 1,784,762 | 12/1930 | Smith | 241/11 |
| 2,464,212 | 3/1949 | Carter et al. | 241/7 |
| 2,759,511 | 8/1956 | Jacobson | 241/7 X |
| 2,941,730 | 6/1960 | Mertz et al. | 241/9 |
| 3,226,041 | 12/1965 | Graumann | 241/9 |

*Primary Examiner*—Granville Y. Custer, Jr.
*Attorney, Agent, or Firm*—Laurence R. Brown

[57] ABSTRACT

This invention refers to a process for the manufacture of sorghum flour and the object of this invention is to obtain flour by a dry process, avoiding with it production of sorghum flour by a humid method.

2 Claims, 1 Drawing Figure

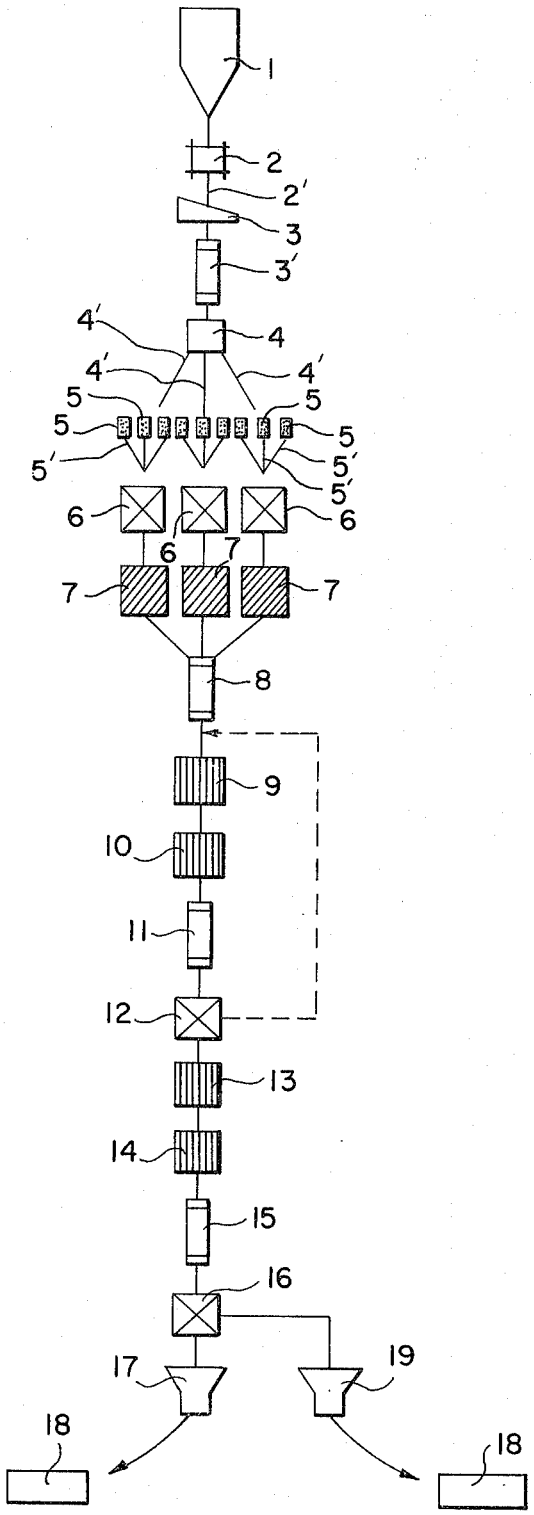
1
2
2'
3
3'
4'
4
4'
4'
5
5
5
5
5'
5'
5'
6
6
6
7
7
7
8
9
10
11
12
13
14
15
16
17
19
18
18

PROCESS FOR THE MANUFACTURE OF SORGHUM FLOUR

This invention refers to a process for the manufacture of sorghum flour and the object of this invention is to obtain flour by a dry process, avoiding with it, some of the disadvantages derived by the processes known to date, by which they produce sorghum flour by a humid method and have as a result a series of disturbances such as unnecessary storing of the flours while in the line of processing; dampening of pieces, including the accumulation of masses in some of the machines; their breakage all of which is avoided by means of the processing in this specification.

In accord with the present process, the dirty sorghum, just as it comes from the country, is received in a receiver chute 1 and from there goes to a scale 2 in such a way that the exact weight that is going to be processed is obtained. This has special importance in that it avoids whatever loss there might be if it was weighed before being put into the receiver chute 1. Once the sorghum has been weighed it passes by means of a duct 2' to a seive 3 that by means of airation separates the shell that covers the sorghum. Having done this, by means of a transporter 3' which can be a duct, a band or an elevator (this last when the system is in a vertical form) passes to a chute 4 where the now clean sorghum is placed momentarily so as to later go to the polishers 5 which can vary in number according to the need of the volume of production that you wish to have. The sorghum passes to these polishers 5 by feed ducts 4' which can work by gravity or by injection. In these machines the grain receives friction on all its surfaces which cleans it of any impurity which it might have and, after completing the polishing, passes by means of duct 5' or conductors to the sifters 6 whose purpose is to separate the sorghum grain from all the dust of the shells and residue that at this point have come with the grain. At these sifters 6 the waste goes through a duct to the waste chute while the grain passes some vacuums 7; where, by suction, the grain is cleaned of the last residue and impurity that might have adhered to the surfaces, (impurities which principally consist of bran that has remained after the grain has passed the sifters). The grain passes by means of a conductor 8 which may be a duct, transformer or, elevator in the case of a vertical process to a mill 9 that consists of special striated rolling pins by which the grain is broken so that it will later pass to a large mill 10 that has finer striations on its rolling pins where it refines the flour that results from the mill 9. This operation done, the resulting flour is transported by means of a conductor 11 to a sifter 12 that consists of various sections, each section with a special caliber of selector by which the bran is separated from the fine flour. From here the fine flour will go to another mill 13 where it will receive a further treatment to homogenize it, reducing its volume. From this mill it can leave as completed flour or it may be put through a treatment of refining where it will go to a mill 14. Once this flour is refined in this mill 14 it will pass by conductor 15 to a sifter 16 which will finally separate those heavy particles that have stayed in spite of the milling. When this has been accomplished the heavy flour is directed to the general chute 17 where it will go to the warehouse 18 meanwhile the refined flour will pass to a special chute 19 where it will pass to a warehouse 18 also for its proper packaging.

I must clarify that in this present process one utilizes an apparatus, be it a sifter, mill or vacuum for each step, but in actual practice, one apparatus can complete both steps for example when I speak of a sifter 16 and a sifter 12 in the diagram which I am presenting for this process, the sifters in the steps are different, nevertheless in practice one may effect a return to the mills 9 and 10 from the sifter 12 as shown by dotted line which will give the same results, with the understanding that in these circumstances one saves one machine. It is prudent to clarify that what was claimed in the process is the general principle through which one submits sorghum to a treatment as described which, will give as a result flour produced by a process based on dry production.

What I claim is:

1. A dry process of manufacturing sorghum flour in a system through which the sorghum is entered, transported and processed to produce flour comprising the steps of 1. entering raw sorghum into a receiving chute of said system,
2. weighing the raw sorghum before processing by transporting it through said chute to a scale,
3. passing the weighed raw sorghum through a duct to an aerating sieve for separating the shells from the raw sorghum as a first processing step,
4. transporting the cleaned sorghum through said system for processing,
5. polishing the cleaned sorghum cleaned in previous processing steps by submitting all surfaces to friction,
6. separating residue from the polished sorghum by a vacuum process,
7. breaking the cleaned sorghum with rolling pins,
8. sifting the broken sorghum to separate fine flour,
9. homegenizing the separated fine flour,
10. milling the homogenized fine flour, and
11. separating such milled fine flour into coarse and fine flour.

2. The process defined in claim 1 wherein said system provides continuous flow through transporting ducts and processing equipment at a single location.

* * * * *